US010090589B2

(12) United States Patent
Backman et al.

(10) Patent No.: US 10,090,589 B2
(45) Date of Patent: Oct. 2, 2018

(54) BATTERIES AS ANTENNA FOR DEVICE

(71) Applicant: Microsoft Technology Licensing, LLC, Redmond, WA (US)

(72) Inventors: Juha Backman, Espoo (FI); Miikka Tikander, Helsinki (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 16 days.

(21) Appl. No.: 14/923,760

(22) Filed: Oct. 27, 2015

(65) Prior Publication Data

US 2017/0117622 A1 Apr. 27, 2017

(51) Int. Cl.
*H01Q 1/44* (2006.01)
*H01Q 9/28* (2006.01)
*H01Q 1/50* (2006.01)

(52) U.S. Cl.
CPC ..... *H01Q 1/44* (2013.01); *H01Q 1/50* (2013.01); *H01Q 9/28* (2013.01)

(58) Field of Classification Search
CPC ..... H01Q 1/44; H01Q 1/50; H01Q 9/28
USPC ..... 343/720
See application file for complete search history.

(56) References Cited

U.S. PATENT DOCUMENTS 2,828,413 A * 3/1958 Bowers ..... H01Q 1/24 343/702
6,031,492 A * 2/2000 Griffin ..... H01Q 1/3275 343/702
6,597,320 B2 7/2003 Maeda et al.
6,671,494 B1 * 12/2003 James ..... H04B 1/385 381/15
6,798,168 B1 9/2004 Annamalai et al.
7,483,673 B2 1/2009 Lee
RE42,773 E * 10/2011 Tuttle ..... G01S 13/758 235/380
8,248,316 B2 8/2012 Christensen
8,501,342 B2 8/2013 Byun et al.
8,750,948 B2 6/2014 Wong et al.
2004/0145439 A1 * 7/2004 Grilo ..... H01F 19/08 336/145
2007/0252764 A1 11/2007 Keski-Opas
2009/0312054 A1 12/2009 Choi
(Continued)

FOREIGN PATENT DOCUMENTS

JP 61123308 A 6/1986
JP 11163757 A 6/1999
(Continued)

OTHER PUBLICATIONS

An ultra wideband antenna using button cell batteries, Hubregt J. Visser, Jan. 2011, citation 1, pp. 1-9, https://www.researchgate.net.*
(Continued)

*Primary Examiner* — Huedung Mancuso

(57) ABSTRACT

Batteries as an antenna for a device are disclosed. In an embodiment, the device comprises: at least two batteries, each battery comprising at least two conductive portions; a radio frequency, RF, isolation component configured between the at least two batteries; a transformer configured to connect a radio frequency signal to the at least two conductive portions of the at least two batteries, wherein the at least two conductive portions are configured as an antenna of the device.

20 Claims, 9 Drawing Sheets

(56) References Cited

U.S. PATENT DOCUMENTS

| | | | |
|---|---|---|---|
| 2011/0250837 | A1 | 10/2011 | Hwang et al. |
| 2014/0071004 | A1 | 3/2014 | Jenwatanavet et al. |
| 2014/0091974 | A1 | 4/2014 | Desclos et al. |

FOREIGN PATENT DOCUMENTS

| | | | |
|---|---|---|---|
| JP | 2002238086 | A | 8/2002 |
| JP | 2008072372 | A | 3/2008 |

OTHER PUBLICATIONS

Kivekäs, Outi, "Design of High-Efficiency Antennas for Mobile Communications Devices", In Thesis of Helsinki University of Technology, Aug. 2005, 51 pages.

* cited by examiner

BATTERIES AS ANTENNA FOR DEVICE

BACKGROUND

In radio communication devices, the space occupied by an antenna element may affect the physical size of the device. Although this may generally apply to all radio communication devices, it particularly applies to very small radio communication devices where space is a premium. Furthermore, antenna efficiency may be affected by limitation of the size of the antenna elements. Typically, these radio communication devices have batteries which are built in the radio communication devices for powering the devices for operation.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

Batteries as an antenna for a device are disclosed. In an embodiment, the device comprises: at least two batteries, each battery comprising at least two conductive portions; a radio frequency, RF, isolation component configured between the at least two batteries; a transformer configured to connect a radio frequency signal to the at least two conductive portions of the at least two batteries, wherein the at least two conductive portions are configured as an antenna of the device.

Many of the attendant features will be more readily appreciated as they become better understood by reference to the following detailed description considered in connection with the accompanying drawings.

DESCRIPTION OF THE DRAWINGS

The present description will be better understood from the following detailed description read in light of the accompanying drawings, wherein.

Like references are used to designate like parts in the accompanying drawings.

DETAILED DESCRIPTION

The detailed description provided below in connection with the appended drawings is intended as a description of the present embodiments and is not intended to represent the only forms in which the present embodiment may be constructed or utilized. However, the same or equivalent functions and sequences may be accomplished by different embodiments.

Although the present embodiments may be described and illustrated herein as being implemented in compact radio frequency devices, these are only examples of devices wherein batteries are configured as antennas and not a limitation. The present embodiments are suitable for application in a variety of different types of devices, for example, in smartphones, mobile phones, tablets, phablets, game consoles, small laptop computers, smart watches, wearable devices or any other device that has a need for and/or may benefit from batteries that are configured as antennas.

Figure 1:
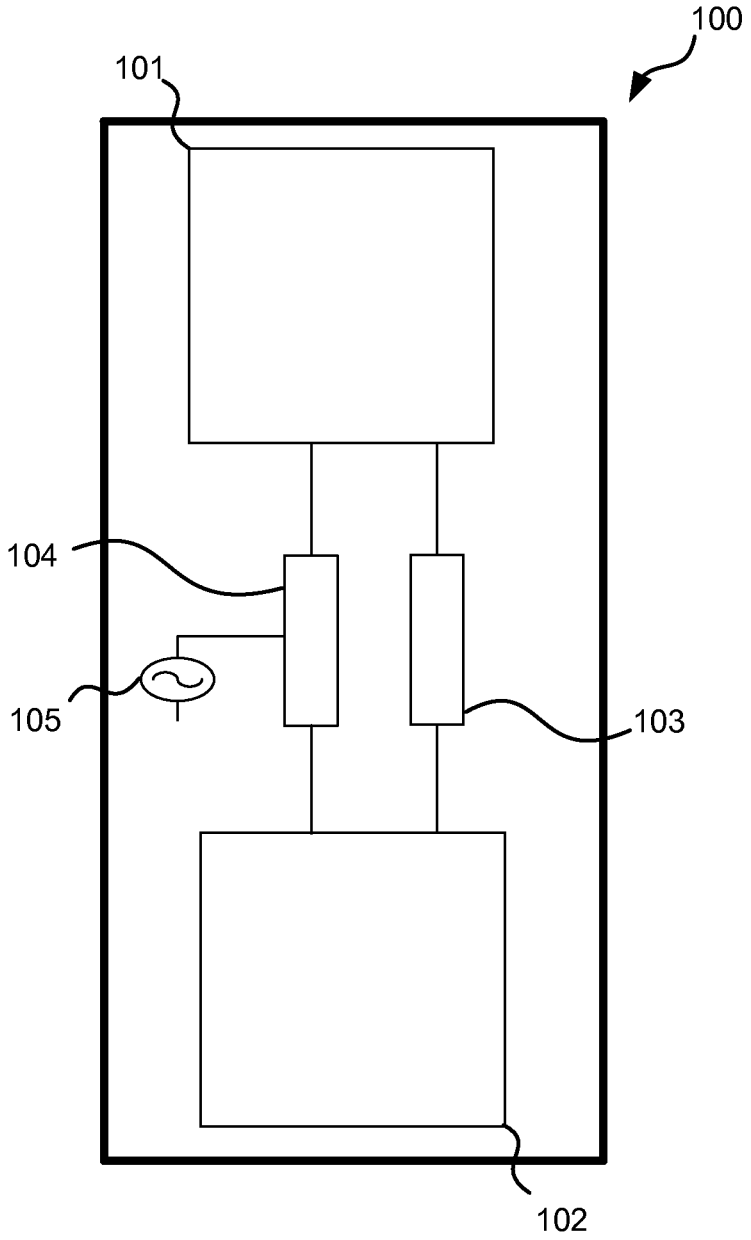
FIG. 1 illustrates a schematic representation of a device with batteries configured as an antenna according to an embodiment.

FIG. 1 schematically illustrates an embodiment of a radio communications device 100 comprising batteries 101,102 that are configured as an antenna for the device 100. Furthermore, the device 100 comprises RF isolation 103 between the batteries 101,102, and a RF transformer 104 between a RF unit 105 and the batteries 101,102.

Conductive portions (not shown in FIG. 1) of the batteries 101,102 of the device 100 are used as active radiating, or receiving, elements of the antenna. According to an embodiment, a conductive portion encompasses portions of a battery which are electrically conductive, for example a metal part of the battery such as a cover, a housing, a body or a pin, etc. Two batteries 101,102 are configured as a dipole antenna. The batteries 101,102 may be applied as both primary batteries, for example button cell types which are common in low-power devices, and as rechargeable batteries. RF isolation 103 is configured to isolate conductive portions of separate batteries 101,102 at RF while allowing DC to pass through. A RF transformer 104 is configured to connect a RF signal, which is to be transmitted or received, between the RF unit 105 and RF decoupled parts of the batteries 101,102.

According to an embodiment the conductive portions of individual batteries 101,102 are connected at RF so that they act as a single radiating or receiving surface. This may be effected by a capacitor (not illustrated in the embodiment of FIG. 1).

According to an embodiment, the radio frequency communication device 100 may be a very compact device, for example such that the device is operable to transmit and/or receive information via radio transmissions as a beacon, RFID tag, etc. According to an embodiment, the device 100 may be smaller than a typical mobile phone. The device 100 may be a fully functional apparatus or may be a module for incorporation within an apparatus. It may be hand-portable.

The radio communications device 100 comprises compartments for receiving a first battery 101 and a second battery 102. The battery 101,102 may be inserted into the compartment by a user of the device 100. It may also be replaceable by the user.

Each battery 101,102 comprises at least one conductive portion, for example a metal housing element, a cover portion, an accessible conductive contact electrically connected to the metal housing element, and external contacts. The external contacts may provide charge stored in the battery to the device 100. The conductive portions operate as radio frequency, RF, antenna elements. The conductive portions transmit electromagnetic waves when the accessible conductive contact is fed with RF electrical signals by the RF unit 105. These RF signals are passed from the accessible conductive contact to the conductive portions which operate as RF antenna elements converting the RF electrical signals into electromagnetic transmissions.

The conductive portions can also receive electromagnetic waves, convert them to RF electrical signals and feed the RF electrical signals via the accessible conductive contact to the device 100, for example into the RF unit 105.

The bandwidth and/or resonant frequency of the antenna elements may be tuned by varying their size, the position of the accessible conductive contact and its position relative to the PWB. For example, increasing the size of the conductive portion will typically increase the electrical length of the antenna which in turn decreases the resonant frequency.

According to an embodiment, the device 100 is configured to use standard or non-proprietary radio protocols. Commonly used protocols, Bluetooth, and Wifi, use radio frequencies ranging from 2.4 to 5 GHz, whereas Z-wave works around 900 MHz, and Zigbee works in both of the previously mentioned frequency ranges. According to an embodiment, low-power communication may also be used also in other frequency ranges, starting from the 27 MHz unlicensed band, used in some remote control applications like car keys, for example.

According to an embodiment an individual device may use frequencies within a relatively narrow band, for example Bluetooth or a single WLAN band only, which simplifies the antenna design. The frequency band may be designed accordingly for different carriers and frequency ranges.

According to an embodiment, manufacturing and device costs may be saved due to reduction of the number of components of the device 100. Furthermore, physical space inside the device 100 may be saved, and consequently the device 100 can be made smaller. The manufacturing process may be simplified as compared to printed antennas, for example. There may not be a need for specially designed antenna elements, because batteries are configured to act as the antenna elements. Despite of the saves in cost and space, efficient operation may be achieved when the dimensions can be chosen suitably.

Figure 2:
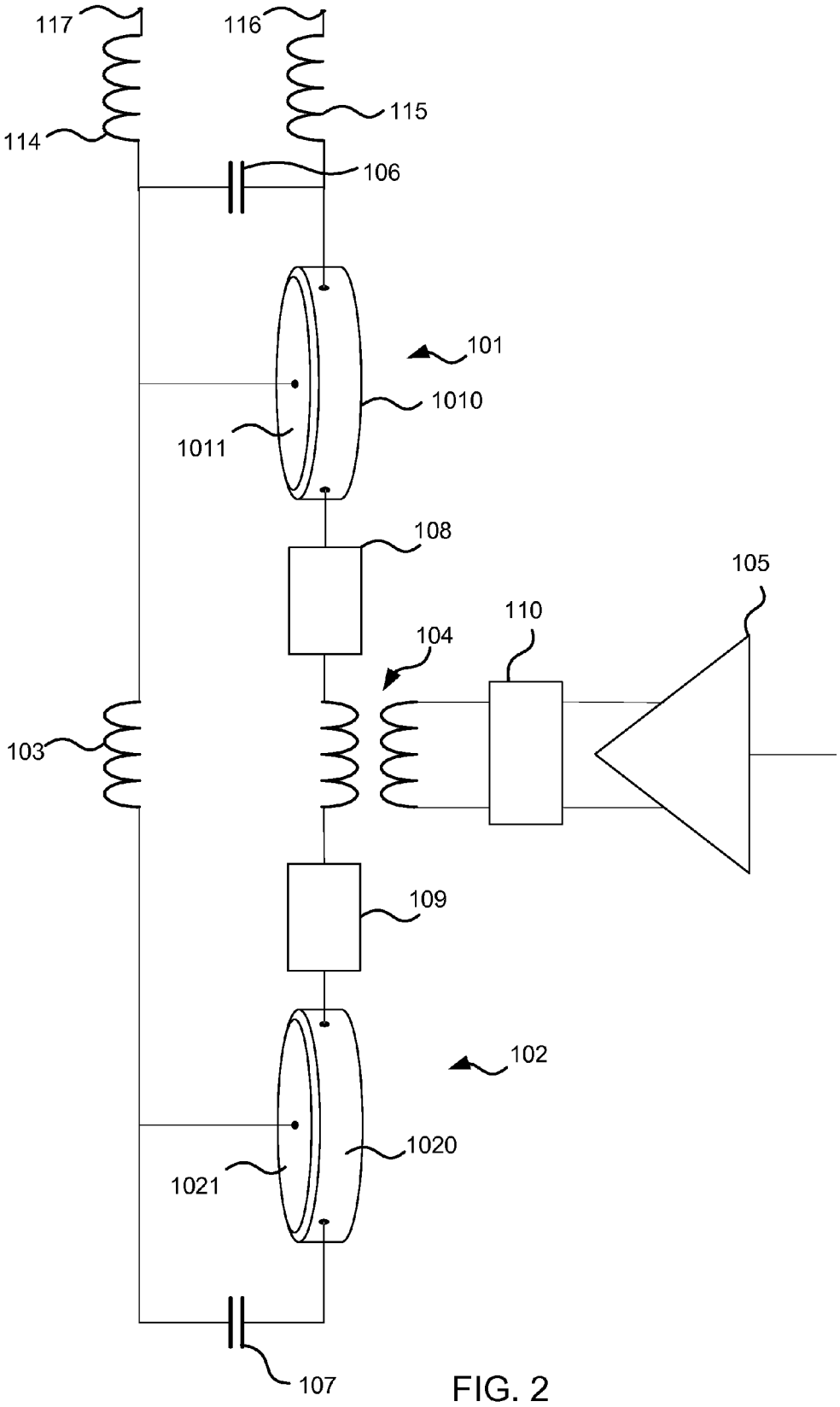
FIG. 2 illustrates a schematic representation of a circuit configured to use two batteries to form a dipole antenna, wherein the batteries are in parallel according to an embodiment.

FIG. 2 illustrates a schematic representation of a circuit of the device 100 configured to use two batteries 101,102 to form a dipole antenna. The batteries 101,102 are in parallel in the circuit of FIG. 2. The embodiment of FIG. 2 uses two batteries 101,102 that are connected in parallel at DC and low frequencies.

The device 100 comprises RF isolation 103. The RF isolation 103 is configured between the minus poles 1011, 1021 of the batteries 101, 102. The RF isolation 103 may be a coil. The RF isolation 103 is configured to connect the batteries 101,102 at DC, and disconnect the circuit at RF. Consequently, the conductive portions of the separate batteries are isolated at RF, and DC is allowed to pass through. The device 100 comprises RF shortcuts 106, 107. The RF shortcut may be a capacitor. The RF shortcut 106,107 connects two conductive portions, for example both electrodes, of an individual battery at RF so that they act as a single radiating or receiving element/surface. The capacitor short-circuits the minus 1011,1021 and plus 1010,1020 poles of the battery. This creates one unified electrically conductive surface to improve antenna performance. At DC, the capacitor isolates the battery poles. It may also prevent resonation.

The device 100 comprises a RF unit 105 and a RF transformer 104. The RF transformer 104 is configured between impedance matching units 108,109,110 and between the batteries 101,102 and the RF unit 105. The RF transformer 104 connects the RF signal, which is to be transmitted or received, to the RF decoupled parts of the batteries 101,102 in a symmetrical manner. It also decouples the DC potential from the RF unit 105. According to an embodiment, the transformer may be a short circuit at DC, consequently connecting the plus poles 1010,1020 of the batteries. According to an embodiment, instead of the RF transformer 104, there may be a pair of balanced RF power amplifiers or receivers, decoupled by capacitors. The device 100 comprises one or more impedance matching and phase shifting units 108,109,110. The units 108,109,110 are configured between the RF transformer 104 and plus poles 1010,1020 of the batteries 101,102 and the RF unit 105. The impedance matching units 108,109,110 are configured to tune the dipole antenna phases, for example due to unideal antenna dimensions. The device 100 furthermore comprises a DC output 116,117 which is secured by RF isolations 114,115.

Figure 3:
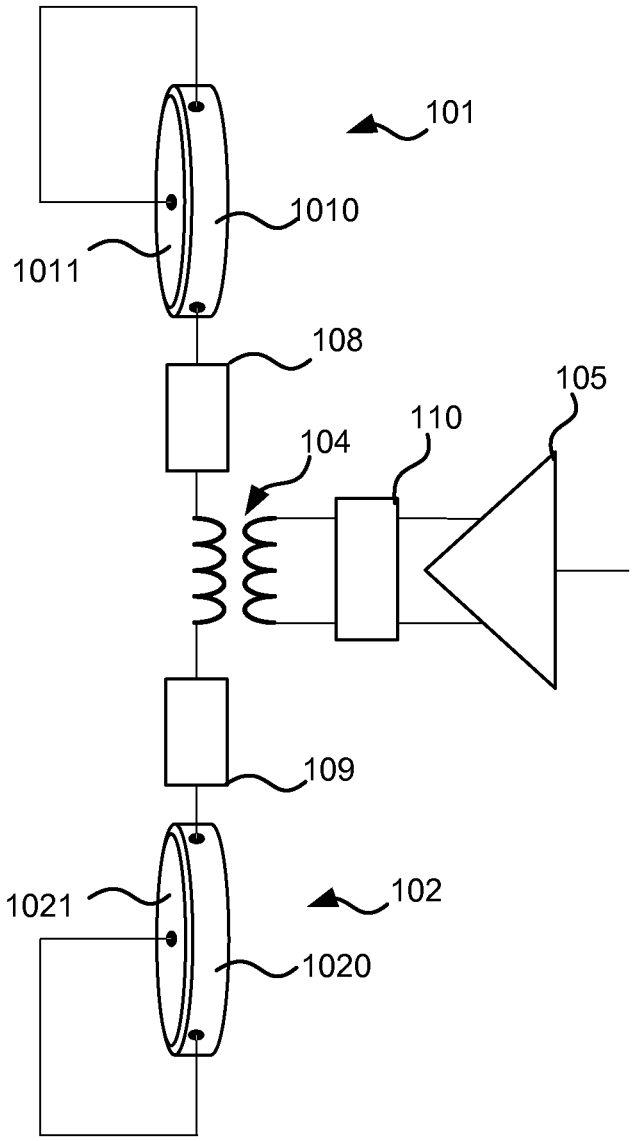
FIG. 3 illustrates a schematic representation of a circuit of FIG. 2 configured to be operated in a radio frequency, RF, domain according to an embodiment.

FIG. 3 illustrates a schematic representation of a circuit of FIG. 2 configured to be operated in a radio frequency domain according to an embodiment. In the RFs, capacitors become short circuits, whereas coils/inductors become open circuits. Consequently, in the circuit of FIG. 3 there is a short circuit instead of the capacitors 106,107. Furthermore, there is an open circuit instead of the coil 103. Additionally, there are open circuits instead of the coils 114,115. The batteries 101,102 and their conductive portions 1011,1010,1021,1020 are acting as an antenna for the RF unit 105.

Figure 4:
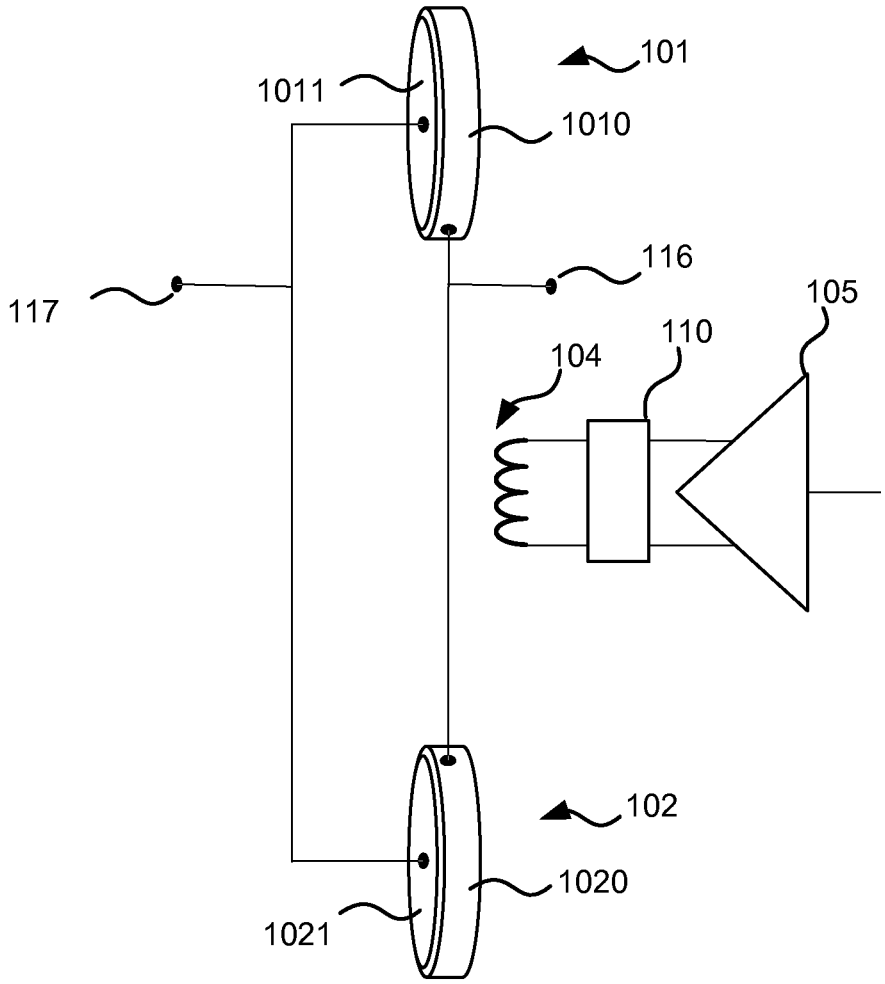
FIG. 4 illustrates a schematic representation of a circuit of FIG. 2 configured to operate in a direct current, DC, domain according to an embodiment.

FIG. 4 illustrates a schematic representation of a circuit of FIG. 2 configured to operate in a DC domain according to an embodiment. The RF signals are decoupled from the DC domain by the transformer 104, and there is a short circuit instead. Furthermore, instead of coils 103,114,115 there are short circuits. Instead of capacitors 106,107 there are open circuits, and DC outputs 116,117 are shown. Batteries 101, 102 are in parallel. The batteries 101,102 are acting as a power source for the device 100.

Figure 5:
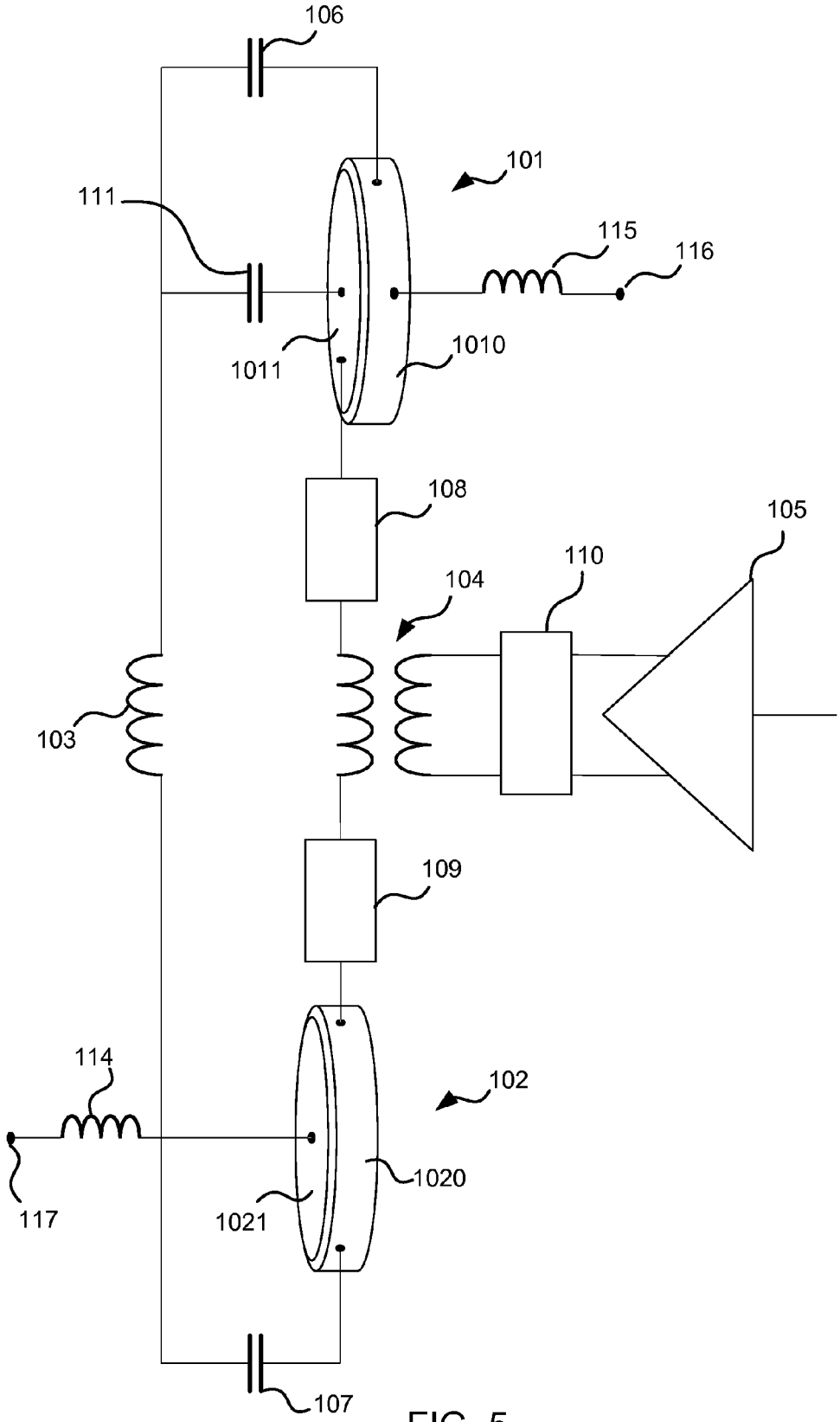
FIG. 5 illustrates a schematic representation of a circuit configured to use two batteries to form a dipole antenna, wherein the batteries are in series according to an embodiment.

FIG. 5 illustrates a schematic representation of a circuit configured to use two batteries 101,102 to form a dipole antenna, wherein the batteries 101,102 are in series according to an embodiment. The embodiment of FIG. 5 is generally similar to the embodiment of FIG. 2, except that the batteries are configured in series in the DC domain. In the embodiment of FIG. 5, the DC output 117 and the RF isolation 114 are connected to battery 102. They are connected to the minus pole 1021 of the battery 102. The DC output 116 and the RF isolation 115 are connected to battery 101. They are connected to the plus pole 1010 of the battery 101. Furthermore, the embodiment of FIG. 5 includes a RF shortcut 111 between the minus pole 1011 of the battery 101 and the RF isolation 103 and the RF shortcut 106.

Figure 6:
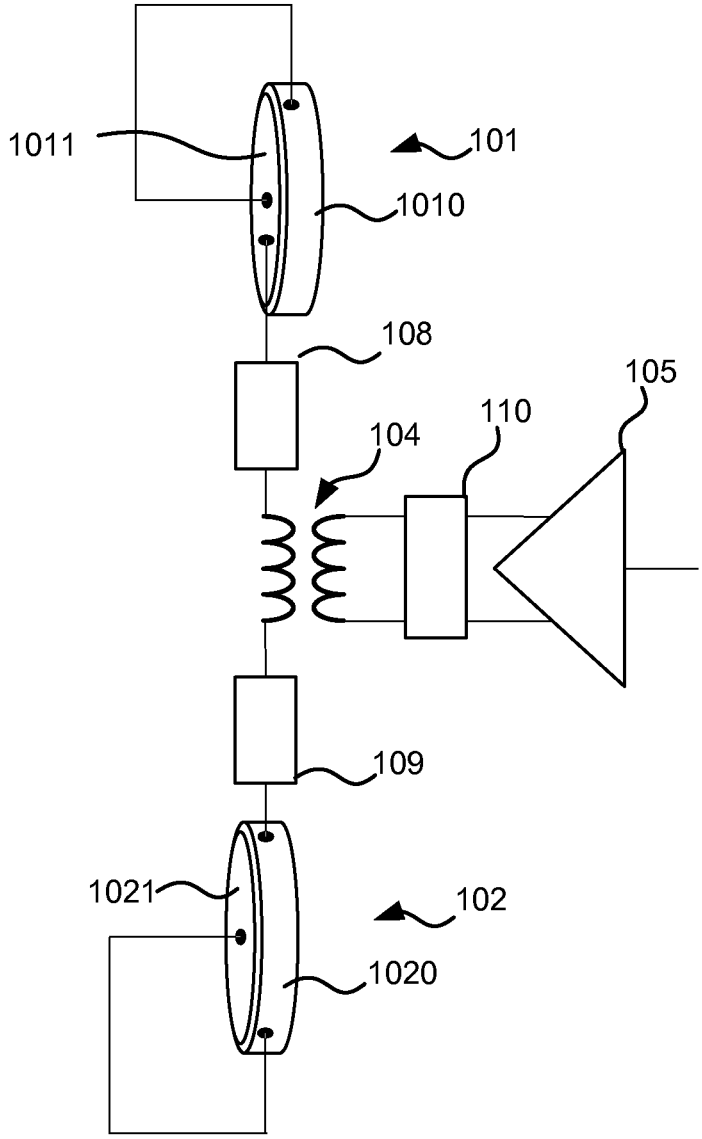
FIG. 6 illustrates a schematic representation of a circuit of FIG. 5 configured to be operated in a RF domain according to an embodiment.

FIG. 6 illustrates a schematic representation of a circuit of FIG. 5 configured to be operated in a radio frequency domain according to an embodiment. In the RFs, capacitors become short circuits, whereas coils/inductors become open circuits. Consequently, in the circuit of FIG. 6 there is a short circuit instead of the capacitors 106,107 and 111. Furthermore, there is an open circuit instead of the coil 103. Additionally, there are open circuits instead of the coils 114,115. The batteries 101,102 and their conductive portions 1011,1010,1021,1020 are acting as an antenna for the RF unit 105.

Figure 7:
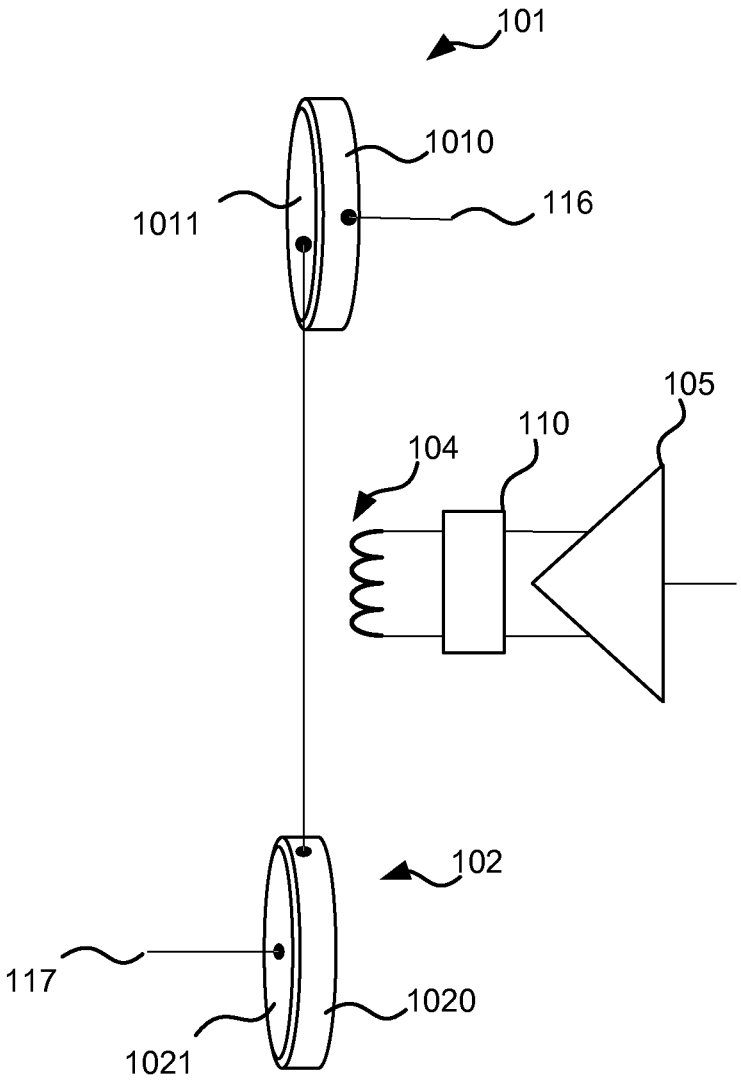
FIG. 7 illustrates a schematic representation of a circuit of FIG. 5 configured to operate in a DC domain according to an embodiment.

FIG. 7 illustrates a schematic representation of a circuit of FIG. 5 configured to operate in a DC domain according to an embodiment. The RF signals are decoupled from the DC domain by the transformer 104, and there is a short circuit instead. Furthermore, instead of coils 103,114,115 there are short circuits. Instead of capacitors 106,107,111 there are open circuits, and DC outputs 116,117 are shown. Batteries 101,102 are in series. The batteries 101,102 are acting as a power source for the device 100.

Figure 8:
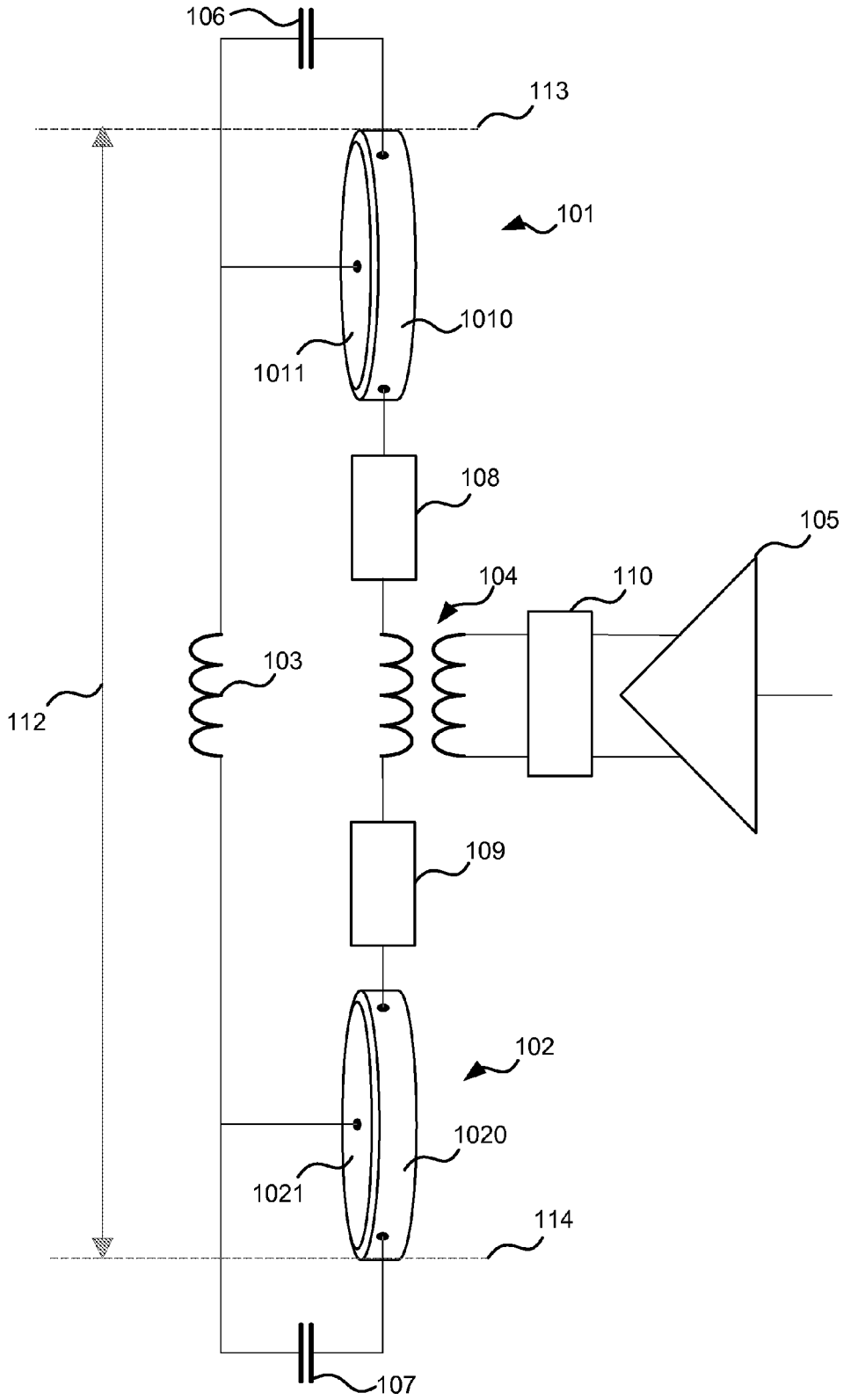
FIG. 8 illustrates a schematic representation of size considerations of the circuit according to an embodiment.

FIG. 8 illustrates a schematic representation of size considerations of the circuit according to an embodiment. The embodiment of FIG. 8 illustrates target dipole antenna dimensions for an optimal efficiency. The length 112 between the ends of the batteries 101,102 may be 5λ/4 or λ/2. It should be noted that the numerical values may vary and this is merely an example of the distance between the ends of the batteries. For example, the antenna may operate without a strictly optimal dimension configuration.

According to an embodiment, batteries 101,102, possibly together with other conductive portions, for example metal parts, that were previously considered passive parts, are isolated from each other at radio frequencies so that they can act as components of a transmitting or receiving antenna. Furthermore, RF transmitter or receiver electronics 105 are coupled to the batteries 101,102, providing the necessary DC or low frequency isolation. The DC and RF may operate simultaneously on the device 100, although some embodiments illustrate them in separate configurations. Because of the configurations, they do not disturb each other and allow simultaneous operations.

The term 'computer', 'computing-based device', 'apparatus' or 'mobile apparatus' is used herein to refer to any device with processing capability such that it can execute instructions. Such processing capabilities are incorporated into many different devices.

Figure 9:
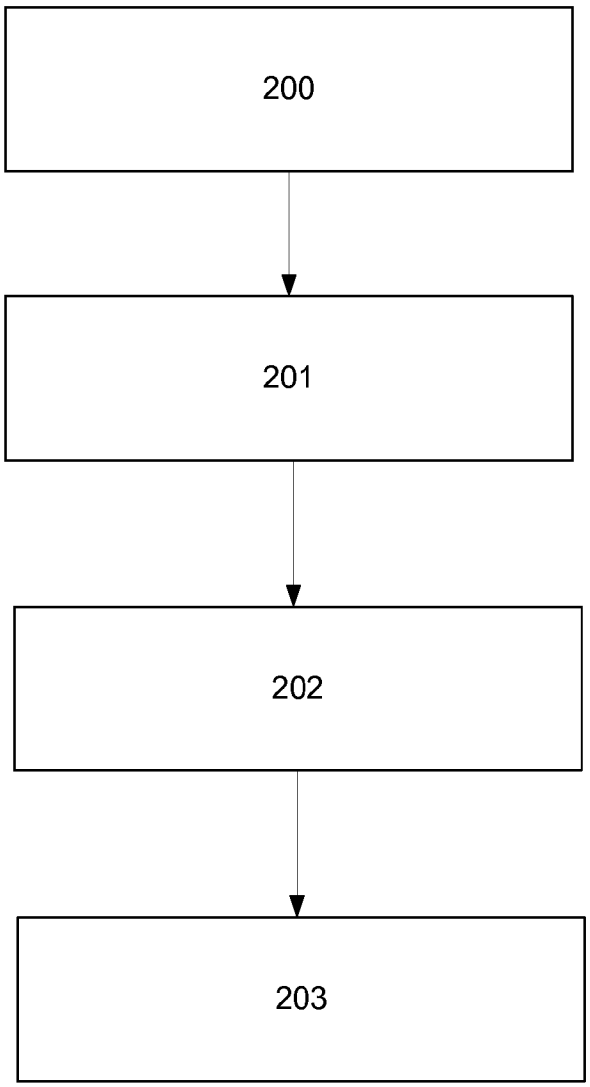
FIG. 9 illustrates a process of operating the device, in accordance with an illustrative embodiment.

An embodiment of a process for operating the device 100 is illustrated in FIG. 9.

According to an embodiment, the method comprises the following steps. In step 200, the conductive portions of the separate batteries are isolated at RF. For example, the metal parts of the batteries are isolated. The RF domain comprises an open circuit accordingly. DC is allowed to pass through, and the DC domain comprises a closed circuit accordingly. In step 201, both conductive portions of an individual battery are connected at the RF. Consequently, they act as a single radiating or receiving surface. For example both electrodes, the plus and minus poles, can be connected. In step 202, the RF signal, to be transmitted or received, is connected to the conductive portions of the batteries. This may be made in a symmetrical manner. DC potential can be disconnected from the RF unit, for example from the transmitter or receiver. In step 203, impedance matching and phase sifting are provided. They may correct antenna function and amplifier loading.

Consequently, the conductive portions of the batteries are configured as an antenna for the device, and there is no need to have any specific antenna elements within the device.

Any range or device value given herein may be extended or altered without losing the effect sought. Also any example may be combined to another example unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as embodiments of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the embodiments described above may be combined with aspects of any of the other embodiments described to form further embodiments without losing the effect sought, or without extending beyond the disclosure.

The term 'comprising' is used herein to mean including the method, blocks or elements identified, but that such blocks or elements do not comprise an exclusive list and a method or apparatus may contain additional blocks or elements.

According to an embodiment, a device is disclosed, comprising: at least two batteries, each battery comprising at least two conductive portions; a radio frequency, RF, isolation component configured between the at least two batteries; and a transformer configured to connect a RF signal to the at least two conductive portions of the at least two batteries, wherein the at least two conductive portions are configured as an antenna of the device.

Additionally or alternatively to the above, the antenna comprises a dipole antenna.

Additionally or alternatively to the above, the RF isolation component is configured to isolate the conductive portions of the separate batteries at the radio frequency of the signal.

Additionally or alternatively to the above, the RF isolation component is configured to pass direct current, DC, between the conductive portions of the separate batteries.

Additionally or alternatively to the above, the RF isolation component comprises an inductor or a coil.

Additionally or alternatively to the above, further including a RF shortcut component configured between the two conductive portions of the single battery.

Additionally or alternatively to the above, the RF shortcut comprises a capacitor.

Additionally or alternatively to the above, the RF shortcut is configured to connect the two conductive portions of the single battery at the RF of the signal.

Additionally or alternatively to the above, the RF shortcut is configured to disconnect the two conductive portions of the single battery at direct current, DC.

Additionally or alternatively to the above, further including another RF shortcut component configured between the conductive portions of one of the batteries and the RF isolation.

Additionally or alternatively to the above, the transformer is configured between the batteries and a RF processing unit of the device.

Additionally or alternatively to the above, the transformer is configured to disconnect direct current, DC between a RF processing unit of the device and the batteries.

Additionally or alternatively to the above, the transformer is configured to connect the DC between the batteries.

Additionally or alternatively to the above, further including impedance matching and phase shifting components between the transformer and batteries.

Additionally or alternatively to the above, the impedance matching and phase shifting components are further configured between the transformer and a RF processing unit of the device.

Additionally or alternatively to the above, the batteries are configured in parallel with respect to direct current, DC; or wherein the batteries are configured in series with respect to DC.

Additionally or alternatively to the above, further including two RF isolations configured between a direct current, DC, output and the conductive portions of the batteries.

Additionally or alternatively to the above, the conductive portions of each battery comprise a plus pole and a minus pole of the battery.

According to an embodiment, a compact radio communication device is disclosed, comprising: two batteries, each battery comprising two conductive portions; a radio frequency, RF, isolation component configured between the two batteries; a transformer configured to connect a RF signal to the two conductive portions of the two batteries, wherein the two conductive portions are configured as an antenna of the radio communication device.

According to an embodiment, a method is disclosed comprising: disconnecting conductive portions of two batteries at radio frequency, RF; connecting the conductive portions at direct current, DC; and connecting a RF signal to the connective portions of the two batteries so that the conductive portions are configured as a dipole antenna for the radio frequency signal.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. A device, comprising:

at least two batteries, each battery comprising at least two conductive portions;

a radio frequency (RF) isolation component configured between the at least two batteries;

a transformer configured to connect a RF signal to the at least two conductive portions of the at least two batteries, wherein the at least two conductive portions are configured as an antenna of the device; and a RF shortcut component configured between two conductive portions of a battery of the at least two batteries to connect minus and plus poles of the battery.

2. The device of claim 1, wherein the antenna comprises a dipole antenna.

3. The device of claim 1, wherein the RF isolation component is configured to isolate the conductive portions of the separate batteries at the radio frequency of the signal.

4. The device of claim 1, wherein the RF isolation component is configured to pass direct current, DC, between the conductive portions of the separate batteries.

5. The device of claim 1, wherein the RF isolation component comprises an inductor or a coil.

6. The device of claim 1, wherein the RF shortcut component is configured between two conductive portions of each battery of the at least two batteries to connect minus and plus poles of each battery.

7. The device of claim 1, wherein the RF shortcut component comprises a capacitor.

8. The device of claim 1, wherein the RF shortcut component is configured to connect the two conductive portions at the RF of the signal.

9. The device of claim 1, wherein the RF shortcut component is configured to disconnect the two conductive portions at direct current (DC).

10. The device of claim 1, further comprising another RF shortcut component configured between the conductive portions of another one of the at least two batteries and the RF isolation component.

11. The device of claim 1, wherein the transformer is configured between the at least two batteries and a RF processing unit of the device.

12. The device of claim 1, wherein the transformer is configured to disconnect direct current (DC) between a RF processing unit of the device and the at least two batteries.

13. The device of claim 12, wherein the transformer is configured to connect the DC between the at least two batteries.

14. The device of claim 1, further including impedance matching and phase shifting components between the transformer and the at least two batteries.

15. The device of claim 14, wherein the impedance matching and phase shifting components are further configured between the transformer and a RF processing unit of the device.

16. The device of claim 1, wherein the at least two batteries are configured in parallel with respect to direct current (DC); or wherein the at least two batteries are configured in series with respect to DC.

17. The device of claim 1, further comprising two RF isolations configured between a direct current (DC) output and the conductive portions of the at least two batteries.

18. The device of claim 1, wherein the plus pole and the minus pole of the battery are configured as the antenna.

19. A compact radio communication device, comprising:

two batteries, each battery comprising two conductive portions;

a radio frequency (RF) isolation component configured between the two batteries;

a transformer configured to connect a RF signal to the two conductive portions of the two batteries, wherein the two conductive portions are configured as an antenna of the radio communication device; and a RF shortcut component configured between the two conductive portions of one battery of the two batteries to connect minus and plus poles of the one battery.

20. A circuit, comprising:

two batteries, each battery comprising two conductive portions;

a radio frequency (RF) isolation component configured between the two batteries;

a transformer configured to connect a RF signal to the two conductive portions of the two batteries, wherein the two batteries with the two conductive portions form a dipole antenna; and a RF shortcut component configured between the two conductive portions of one battery of the two batteries to connect minus and plus poles of the one battery.

* * * * *